US010088256B1

(12) United States Patent
Oglesby

(10) Patent No.: US 10,088,256 B1
(45) Date of Patent: Oct. 2, 2018

(54) REMOVABLY ATTACHABLE BOLT CARRIER CHARGING HANDLE

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 15/990,714

(22) Filed: May 28, 2018

Related U.S. Application Data

(62) Division of application No. 15/225,070, filed on Aug. 1, 2016, now Pat. No. 10,006,726.

(60) Provisional application No. 62/200,147, filed on Aug. 3, 2015.

(51) Int. Cl.
*F41A 3/72* (2006.01)
*F41A 3/20* (2006.01)

(52) U.S. Cl.
CPC . *F41A 3/20* (2013.01); *F41A 3/72* (2013.01)

(58) Field of Classification Search
CPC .... F41A 3/72; F41A 3/00; F41A 35/06; F41A 3/20
See application file for complete search history.

(56) References Cited

U.S. PATENT DOCUMENTS 2,181,131 A * 11/1939 Johnson, Jr. ..... F41A 3/72 42/16
4,020,577 A * 5/1977 Duffy ..... F41A 3/72 42/106
2014/0013641 A1* 1/2014 Warburton ..... F41A 3/22 42/16

FOREIGN PATENT DOCUMENTS

DE 10122345 C1 * 10/2002 ..... F41A 3/72

* cited by examiner

*Primary Examiner* — Stephen Johnson
(74) *Attorney, Agent, or Firm* — Shaddock Law Group, PC

(57) ABSTRACT

A bolt carrier and removably attachable charging handle including at least some of a bolt carrier having at least one attachment aperture; a handle base having a base attachment portion and a handle attachment portion, wherein the base attachment portion is capable of being removably attached or coupled within at least a portion of the at least one attachment aperture; and a handle sleeve capable of being removably attached or coupled to the handle attachment portion of the handle base.

6 Claims, 10 Drawing Sheets

REMOVABLY ATTACHABLE BOLT CARRIER CHARGING HANDLE

CROSS-REFERENCE TO RELATED APPLICATIONS

This is a Divisional of U.S. patent application Ser. No. 15/225,070, filed Aug. 1, 2016, now U.S. Pat. No. 10,006,726, which claims the benefit of U.S. Patent Application Ser. No. 62/200,147, filed Aug. 3, 2015, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearm components. More specifically, the present invention relates to a bolt carrier and/or removably attachable charging handle adaptable to be used with a firearm.

2. Description of Related Art

A number of self-loading, semi-automatic or fully automatic firearms operate based on a gas blowback system. One such firearm is the M-16, M-4, and AR-15 family of firearms. The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylindrical gas aperture 32 of the bolt carrier key 30, between the bolt carrier 20 and the bolt 50 and drives the bolt carrier 20 rearward.

The buffer, which is pushing on the rear of the bolt carrier group 10, is forced rearward by the bolt carrier group 10 compressing the recoil spring. During this rearward movement, a cam pin track or slot 21 in the upper portion of the bolt carrier 20 acts on the bolt cam pin 40, translating the rearward linear movement of the carrier into rotational movement, thereby rotating the cam pin 40 and bolt 50 clockwise so that the bolt locking lugs are unlocked from the barrel extension locking lugs. As the rearward movement of the bolt carrier group 10 continues, the empty cartridge case is extracted from the chamber, and ejected through the ejection port.

As the bolt carrier group 10 clears the top of an inserted magazine and the empty cartridge case is expelled, a new round is pushed into the path of the bolt 50 by the upward thrust of the magazine follower and spring.

As the bolt carrier group 10 continues to move rearward, it overrides the hammer and forces the hammer down into the receiver, compressing the hammer spring, and allowing the rear hook of the hammer to engage with the hammer disconnect.

When the bolt carrier group 10 reaches its rearmost position (when the rear of the buffer contacts the rear of the buffer tube), the compressed recoil spring expands, driving the buffer assembly forward with enough force to drive the bolt carrier group 10 forward, toward the chamber, initiating chambering of the waiting round from the magazine into the chamber.

The forward movement of the bolt 50 ceases when the locking lugs pass between the barrel extension locking lugs and the round is fully chambered. When the bolt carrier 20 enters the final portion of its forward movement, the bolt cam pin 40 emerges from the cam pin guide channel in the upper receiver and moves along the cam pin slot 21, rotating the bolt 50 counterclockwise. This rotation locks the bolt 50 to the barrel extension (by interaction of the bolt locking lugs and the barrel extension locking lugs). The locking of the bolt 50 completes the cycle of operation and, when the trigger is released, the rear hammer hook hammer slips from the disconnect and the front hammer hook is caught by the sear of the trigger. The firearm is then ready to be fired again.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, it would be advantageous if a self-loading, semi-automatic or fully automatic type firearm were able to operate in a manner similar to that of a single shot, bolt action firearm. For example, if a semi-automatic AR-15 rifle were to operate as a single shot, bolt action rifle, use of the AR-15 rifle may be permitted for hunting in jurisdictions where bolt action rifles are permitted but semi-automatic rifles are not.

In various exemplary, non-limiting embodiments, the bolt carrier and/or removably attachable charging handle of the present disclosure are able to operate with a firearm that does not have or does not need a gas blowback system. The bolt carrier and/or removably attachable charging handle of the present disclosure is able to be operated by a user who grabs the handle and pulls the handle rearward to eject a case and then lets the handle go in order for the bolt carrier group to travel forward and reload the firearm. Because of the movement of the bolt, as generated by the rearward movement of the bolt carrier and the cam pin, the user does not have to rotate the handle from a locked position to an unlocked position, or vice versa, as with a traditional bolt action rifle.

In various exemplary, nonlimiting embodiments, the charging handle bolt carrier comprises an attachment recess having an alignment aperture and an attachment aperture for attaching an adapter to the charging handle bolt carrier. The adapter then allows a variety of handles and handle configurations to be utilized with the charging handle bolt carrier.

In various exemplary embodiments, the handles and/or handle configurations can be swapped out and are retained by a retaining bolt (such as, for example, and allen head or torx head bolt). The handle may optionally include various, interchangeable handle sleeves and/or handle inserts, which may provide, for example, a knurled portion a rubber or neoprene portion a metal portion with raised rubber segments, and the like. Because of the interchangeability of the handle sleeves and/or handle inserts, a variety of handle sleeves and/or handle inserts may be utilized with the presently disclosed bolt carrier and/or removably attachable charging handle.

In certain exemplary embodiments, a lubrication port or aperture may also be included, which allows a portion of the bolt, within the charging handle bolt carrier, to be lubricated, without removing the bolt from the charging handle bolt carrier.

In certain exemplary, nonlimiting embodiments, a removable or quick disconnect lever or locking arm is provided. In these exemplary embodiments, the lever or locking arm is configured to be pushed down against an integrated spring to engage with a nut machined onto a bolt. In this manner, the lever or locking arm can be used to tighten and untighten the quick disconnect bolt that holds the adapter arm onto the charging handle bolt carrier. So a tool is not required to mount or un-mount the adapter arm and handle assembly. This configuration also allows the adapter arm/handle assembly to be tightened should the adapter arm/handle assembly come loose from the charging handle bolt carrier.

In various exemplary, non-limiting embodiments, the bolt carrier and removably attachable charging handle of the present disclosure comprises a bolt carrier having at least one attachment aperture; a handle base having a base attachment portion and a handle attachment portion, wherein the base attachment portion is capable of being removably attached or coupled within at least a portion of the at least one attachment aperture; and a handle sleeve capable of being removably attached or coupled to the handle attachment portion of the handle base.

In certain exemplary, non-limiting embodiments, the bolt carrier and removably attachable charging handle of the present disclosure comprises a bolt carrier having at least one attachment aperture and at least one alignment aperture; an adapter arm extending from a first end to a second end, an adapter arm extension portion extending proximate the first end of the adapter arm, wherein the adapter arm extension portion includes at least one adapter arm aperture formed therethrough, wherein the adapter arm aperture is capable of being aligned with the attachment aperture, wherein the adapter arm extension portion further comprises at least one registration pin extending from the adapter arm extension portion, wherein the registration pin is capable of being at least partially received within the alignment aperture; an adapter arm retaining bolt capable of passing through the adapter arm aperture and interacting with the attachment aperture; a handle base having a base attachment portion and a handle attachment portion, wherein the base attachment portion is capable of being attached or secured proximate the second end of the adapter arm; and a handle sleeve capable of being removably attached or coupled to the handle attachment portion of the handle base.

In certain exemplary, non-limiting embodiments, the bolt carrier and removably attachable charging handle of the present disclosure comprises a bolt carrier having at least one attachment aperture and at least one alignment aperture; an adapter arm extending from a first end to a second end, an adapter arm extension portion extending proximate the first end of the adapter arm, wherein the adapter arm extension portion includes at least one adapter arm aperture formed therethrough, wherein the adapter arm aperture is capable of being aligned with the attachment aperture, wherein the adapter arm extension portion further comprises at least one registration pin extending from the adapter arm extension portion, wherein the registration pin is capable of being at least partially received within the alignment aperture; a quick disconnect bolt, wherein the quick disconnect bolt comprises a central portion with a threaded attachment portion that extends from a first side of the central portion and a locking arm attachment portion that extends from a second side of the central portion, wherein at least a portion of the attachment portion is capable of passing through the adapter arm aperture and interacting with the attachment aperture; a handle base having a base attachment portion and a handle attachment portion, wherein the base attachment portion is capable of being attached or secured proximate the second end of the adapter arm; and a handle sleeve capable of being removably attached or coupled to the handle attachment portion of the handle base.

Accordingly, the present disclosure provides a bolt carrier and/or removably attachable charging handle that can be used with a standard, semi-automatic rifle.

The present disclosure separately and optionally provides a bolt carrier and/or removably attachable charging handle that allows a semi-automatic rifle to be utilized as a single shot, bolt action rifle.

The present disclosure separately and optionally provides a bolt carrier and/or removably attachable charging handle that allows forward and reverse movement of a removably attachable charging handle, along a single plane, to load a rifle.

The present disclosure separately and optionally provides a bolt carrier that may be utilized in conjunction with a variety of interchangeable removably attachable charging handles.

The present disclosure separately and optionally provides a bolt carrier that may be utilized in conjunction with a variety of removably attachable charging handles and removably attachable charging handle configurations.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems and/or apparatuses.

The exemplary embodiments of the present disclosure will be described in detail, with reference to the following figures, wherein like reference numerals refer to like parts throughout the several views, and wherein.

DETAILED DESCRIPTION OF THE INVENTION

Figure 1:
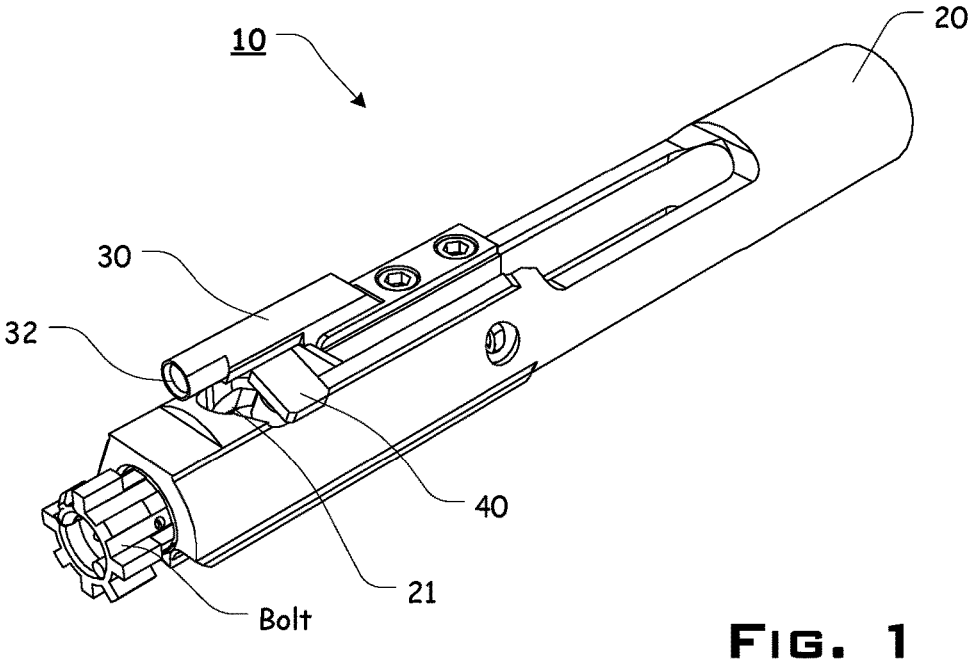
FIG. 1 PRIOR ART
FIG. 1 illustrates an upper, left, front perspective view of a known bolt carrier group.

For simplicity and clarification, the design factors and operating principles of the bolt carrier and/or removably attachable charging handle according to the present disclosure are explained with reference to various exemplary embodiments of a bolt carrier and/or removably attachable charging handle according to the present disclosure. The basic explanation of the design factors and operating principles of the bolt carrier and/or removably attachable charging handle is applicable for the understanding, design, and operation of the bolt carrier and/or removably attachable charging handle of the present disclosure. It should be appreciated that the bolt carrier and/or removably attachable charging handle can be adapted to many applications where a bolt carrier and/or removably attachable charging handle can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "bolt carrier and/or removably attachable charging handle", "charging handle bolt carrier", and "firearm" are used for basic explanation and understanding of the operation of the systems, methods, and apparatuses of the present disclosure. Therefore, the terms "bolt carrier and/or removably attachable charging handle", "charging handle bolt carrier", and "firearm" are not to be construed as limiting the systems, methods, and apparatuses of the present disclosure.

For simplicity and clarification, the bolt carrier and/or removably attachable charging handle of the present disclosure will be described as being used in conjunction with a firearm, such as an AR-15 rifle or carbine. However, it should be appreciated that these are merely exemplary embodiments of the bolt carrier and/or removably attachable charging handle and are not to be construed as limiting this disclosure. Thus, the bolt carrier and/or removably attachable charging handle of the present disclosure may be utilized in conjunction with any firearm.

Figure 2:
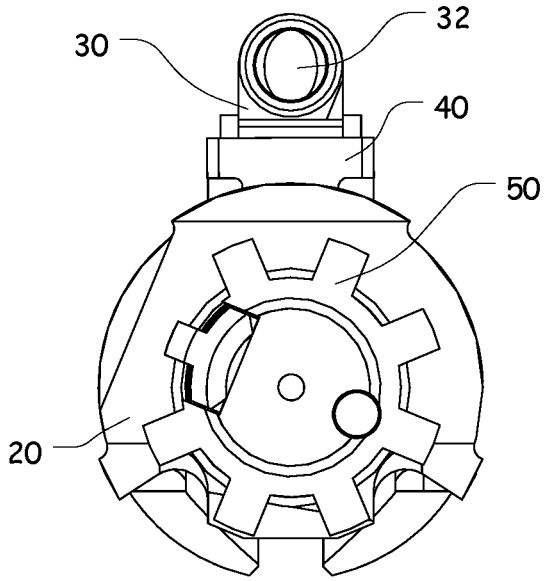
FIG. 2 PRIOR ART
FIG. 2 illustrates a front view of a known bolt carrier group in an unlocked position.
Figure 3:
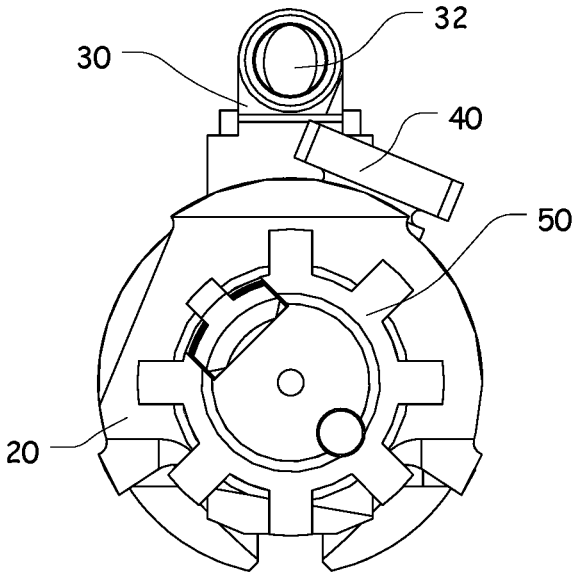
FIG. 3 PRIOR ART
FIG. 3 illustrates a front view of a known bolt carrier group in a locked position.
Figure 4:
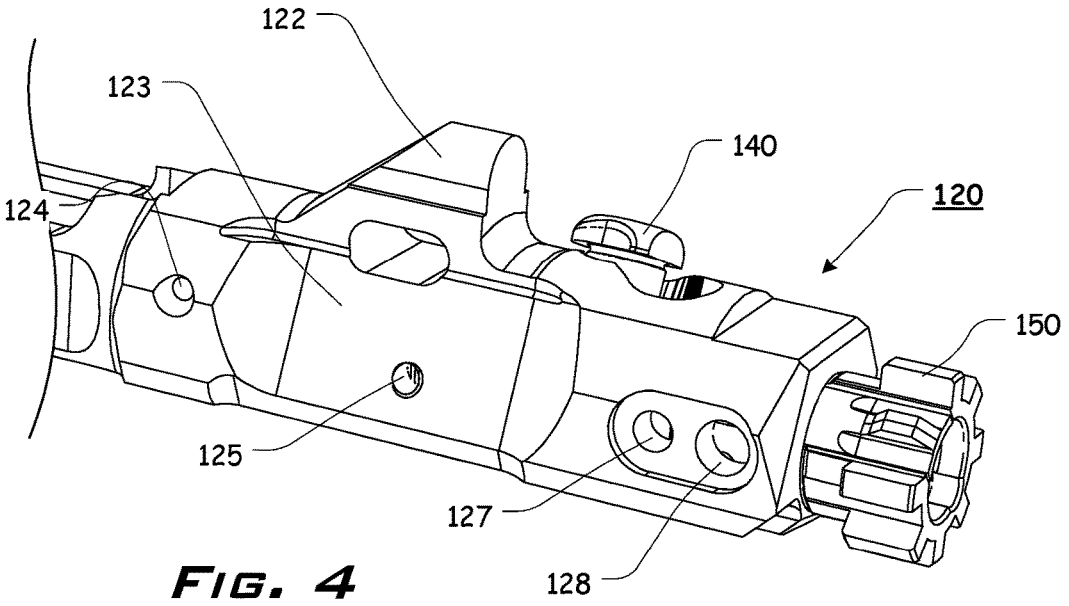
FIG. 4 illustrates an upper, right, front perspective view of a portion of an exemplary embodiment of a charging handle bolt carrier, according to the present disclosure.
Figure 5A:
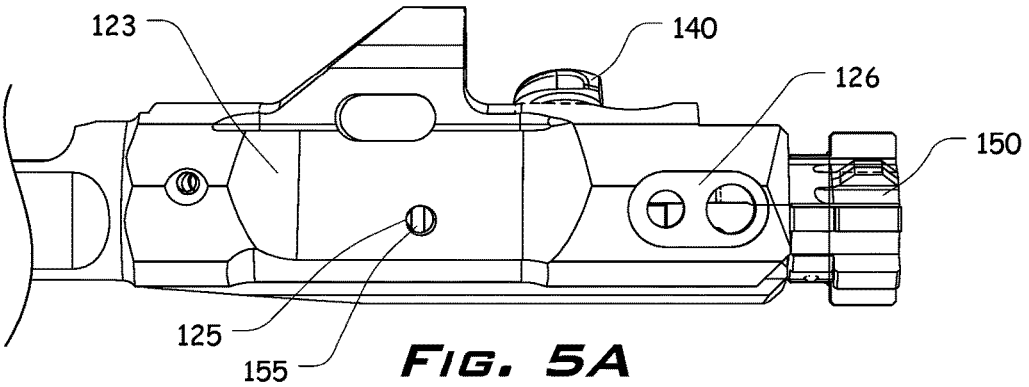
FIG. 5A illustrates an right side perspective view of a portion of an exemplary embodiment of a charging handle bolt carrier, according to the present disclosure.
Figure 5B:
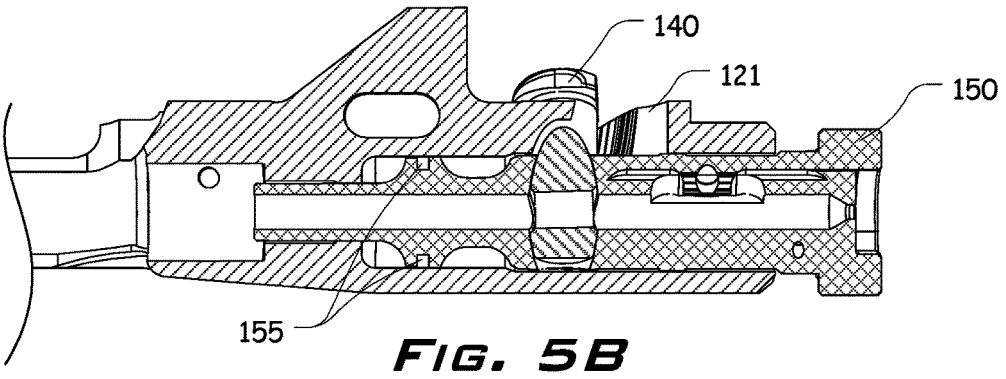
FIG. 5B illustrates an right side cross-sectional view of a portion of an exemplary embodiment of a charging handle bolt carrier, according to the present disclosure.

Turning now to the drawing FIGS., FIGS. 1-3 illustrate certain elements and/or components of a known bolt carrier group. It should be appreciated that the charging handle bolt carrier 120 includes many of the features of the standard bolt carrier 20, as illustrated in FIGS. 1-3. For example, FIGS. 4-5B illustrate certain elements and/or aspects of an exemplary embodiment of a charging handle bolt carrier 120, according to the present disclosure. As illustrated, the charging handle bolt carrier 120 comprises at least some of an ejection port door recess 123, a firing pin retaining pin aperture 124, a cam pin 140, and a cam pin slot 121. The charging handle bolt carrier 120 further comprises an attachment recess 126 formed in at least a portion of the charging handle bolt carrier 120. In various exemplary embodiments, the attachment recess 126 is formed proximate a first end of the charging handle bolt carrier 120, forward of the ejection port door recess 123.

In certain exemplary embodiments, the attachment recess 126 comprises a recessed area formed in the charging handle bolt carrier 120. The overall size and shape of the attachment recess 126 may comprise, for example, an oblong or other shape that resists rotation of an optionally attached or coupled optional handle adapter 168 or adapter arm extension portion 172.

In certain alternative embodiments, the attachment recess 126 may comprise a flat area or portion of the charging handle bolt carrier 120. In still other exemplary embodiments, the attachment recess 126 may comprise an area of the charging handle bolt carrier 120 having one or more extensions, recesses, and/or other surface textures or preparations that are capable of meeting with a corresponding area of an optionally attached optional handle adapter 168 or adapter arm extension portion 172.

The attachment recess 126 further comprises an attachment aperture 128. In various exemplary embodiments, the attachment aperture 128 comprises an internally threaded or partially internally threaded hole or aperture adapted to receive an externally threaded attachment portion of a handle base 160, a quick disconnect bolt 190, or an alternate boulder attachment device. In certain exemplary, nonlimiting embodiments, the attachment aperture 128 may comprise a ½ inch threaded hole.

In still other exemplary, nonlimiting embodiments, the attachment aperture 128 may comprise a hole adapted for receiving at least a portion of a handle base 160 or other protrusion, configured such that the handle base 160 or protrusion can be attached or coupled to the attachment aperture 128 via welding, adhesives, friction fit, or the like.

In various exemplary, nonlimiting embodiments, the attachment recess 126 further comprises an optional alignment aperture 127. The alignment aperture 127, if included, provides an area for a registration pin 173, which extends from the adapter arm extension portion 172 or a registration pin 169, which extends from the optional handle adapter 168, to be received at least partially therein. The interaction between an alignment aperture 127 and registration pin 173 or the registration pin 169 can provide additional strength and may assist in the strong mating of the charging handle bolt carrier 120 to the adapter arm extension portion 172 or the optional handle adapter 168 and to reduce the possibility of rotation of the adapter arm 170 or the optional handle adapter 168 with respect to the charging handle bolt carrier 120. Thus, less movement, or wobble, can be achieved between the charging handle bolt carrier 120 and the adapter arm 170 or the optional handle adapter 168.

A key protrusion 122 may optionally be included as an extension from the main, cylindrical body of the charging handle bolt carrier 120, proximate an area a bolt carrier key appears on the standard bolt carrier.

In certain exemplary embodiments, one or more lubrication apertures 125 may be formed in an area of the ejection port door recess 123 to provide fluid communication between an exterior of the charging handle bolt carrier 120 and a bolt receiving aperture of the charging handle bolt carrier 120. In certain exemplary embodiments, a lubrication aperture 125 may be formed proximate an area where the gas rings are located on a standard bolt. Because the gas rings are not required for operation of the present disclosure, the gas rings may be present or may be removed from the bolt 150. If not included, the gas ring recess 155 may act as a lubrication reservoir.

By having the lubrication aperture 125 formed proximate an area where the gas ring recess 155 (with or without gas rings included) is located on the bolt 150, the user can apply a lubricant to the bolt 150, and, more specifically, to the area proximate the gas ring recess 155, through the lubrication aperture 125, without removing the bolt 150 from the charging handle bolt carrier 120.

Figure 8:
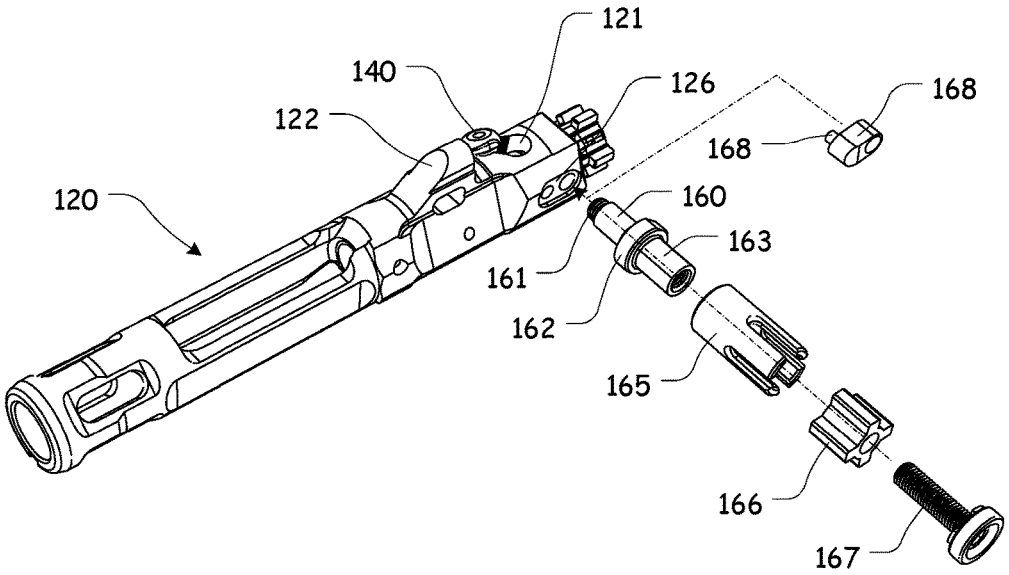
FIG. 8 illustrates a partially exploded, upper, rear, right perspective view of an exemplary embodiment of a bolt carrier and/or removably attachable charging handle, according to the present disclosure.

As illustrated most clearly in FIG. 8, the optional handle adapter 168 is formed so as to include at least a portion that is able to mate with the attachment recess 126 of the charging handle bolt carrier 120. A handle adapter aperture is formed so as to be aligned with the attachment aperture 128 and a registration pin 168 may optionally extend from the optional handle adapter 168 to be aligned with and received at least partially within the alignment aperture 127. It should be appreciated that the overall size and shape of at least a portion of the optional handle adapter 168 is such that it can be abutted against and/or within at least a portion of the attachment recess 126 and attached or coupled to the charging handle bolt carrier 120.

Figure 6:
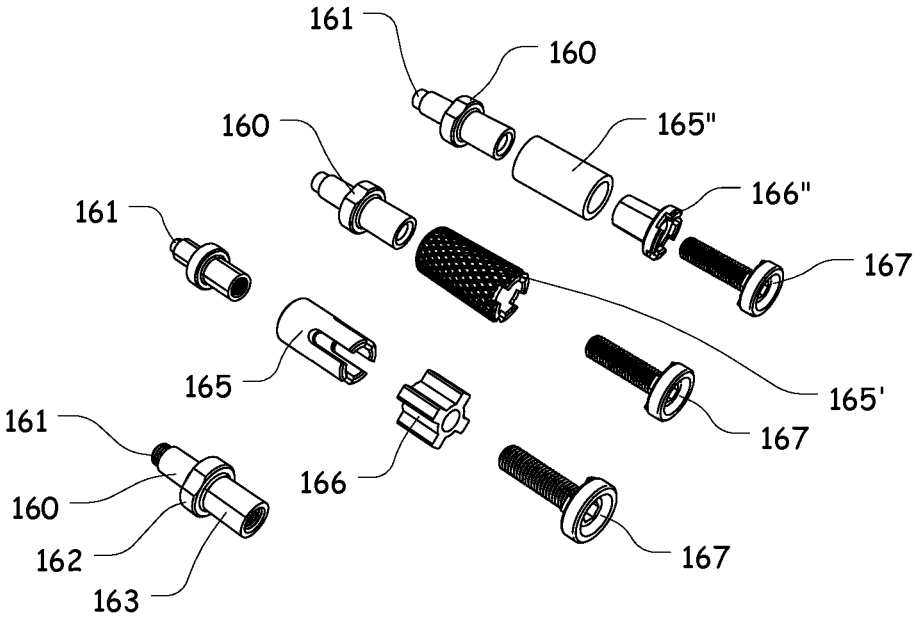
FIG. 6 illustrates an exploded perspective view showing certain components of various exemplary removably attachable charging handle configurations, according to the present disclosure.
Figure 7:
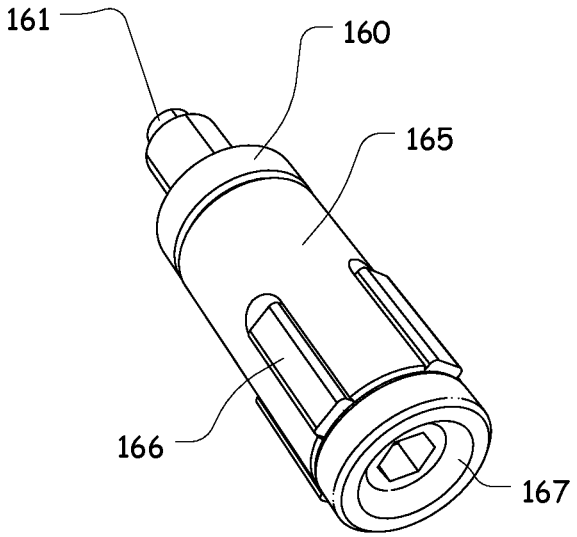
FIG. 7 illustrates a perspective view showing certain components of an exemplary handle base and an exemplary, assembled removably attachable charging handle configuration, according to the present disclosure.

FIGS. 6-7 illustrate certain elements and/or aspects of various exemplary embodiments of exemplary removably attachable charging handles or removably attachable charging handle assemblies, according to the present disclosure.

As illustrated, the charging handle or charging handle assembly comprises a handle base 160. The handle base 160 comprises a body or portion of material having a central portion 162 with a base attachment portion 161 extending from one side of the central portion 162 and a handle attachment portion 163 extending from the other side of the central portion 162. The base attachment portion 161 is adapted to be attached or coupled to the attachment aperture 128. In various exemplary embodiments, the base attachment portion 161 comprises a threaded attachment portion 191, with threads mateable to those of the attachment aperture 128.

In various exemplary, nonlimiting embodiments, the base attachment portion 161 is optionally sized and shaped so as to be received through the handle adapter aperture. When the handle adapter aperture is aligned with the attachment aperture 128, the base attachment portion 161 is able to be threadedly or otherwise attached or coupled to the attachment aperture 128. In this manner, the optional handle adapter 168 is secured to the charging handle bolt carrier 120, via the handle base 160.

In various exemplary embodiments, the central portion 162 of the handle base 160 includes two or more parallel flats, which allow the handle base 160 to be more easily rotated so as to threadedly attach the base attachment portion 161 to the attachment aperture 128.

A handle sleeve 165 is formed so as to be fitted to the handle attachment portion 163 of the handle base 160. The handle sleeve 165 may be formed so as to be removably attached or coupled to the handle attachment portion 163 of the handle base 160, thereby providing interchangeable handle sleeves 165. In certain exemplary embodiments, the handle sleeve 165 may comprise a substantially cylindrical portion of material (such as, for example, cylindrical handle sleeve 165"). Alternatively, the handle sleeve 165 may comprise a portion of material having recesses or grooves formed so as to accept at least a portion of a handle insert 166. If included, the handle insert 166 may comprise a rubber or other material and may provide for additional gripping or text or iced surfaces. In certain exemplary embodiments, the handle sleeve 165 and/or the handle insert 166 may provide, for example, a knurled portion (such as, for example, knurled handle sleeve 165'), a rubber or neoprene portion, a metal portion with raised rubber segments, or the like. It should be appreciated that the overall size, shape, texture, and/or appearance of the handle sleeve 165 and/or handle insert 166 is a design choice based upon the desired appearance and/or functionality of the handle.

Once the handle sleeve 165 and/or handle insert 166 is appropriately positioned relative to the handle attachment portion 163 of the handle base 160, a handle retaining bolt 167, such as, for example, and allen head or torx head bolt, is used to interact with a threaded aperture of the handle attachment portion 163 and removably attach the handle sleeve 165 and/or handle insert 166 to the handle base 160.

In this manner, the handles and/or handle sleeves 165 may optionally be swapped out or interchanged. Because of the interchangeability of the handle sleeves 165 and/or handle inserts 166, a variety of handle sleeves 165 and/or handle inserts 166 may be utilized with the presently disclosed bolt carrier and/or removably attachable charging handle.

Figure 9:
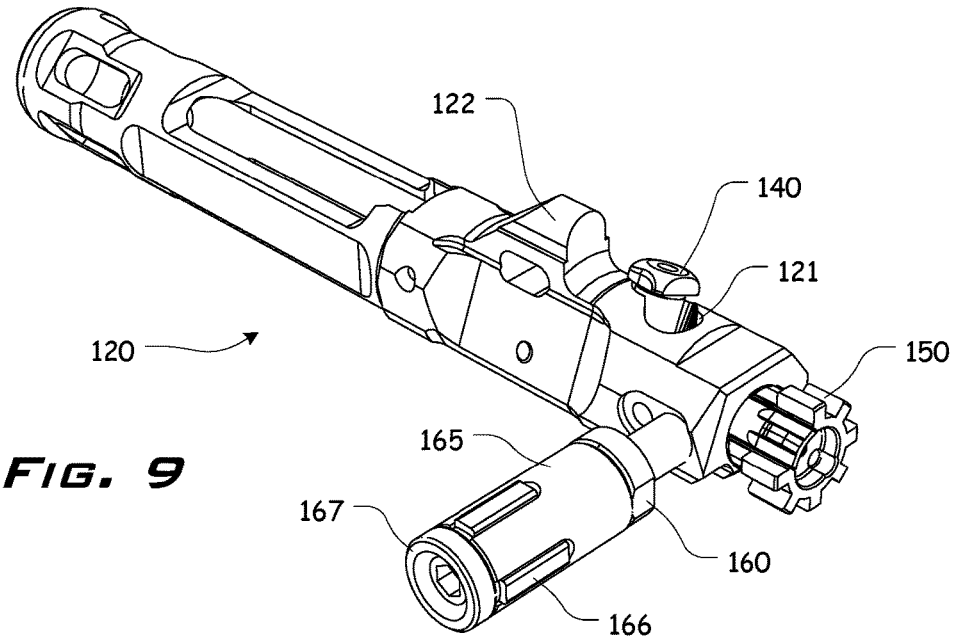
FIG. 9 illustrates an upper, front, right perspective view of an exemplary embodiment of a bolt carrier and/or removably attachable charging handle, according to the present disclosure.
Figure 10:
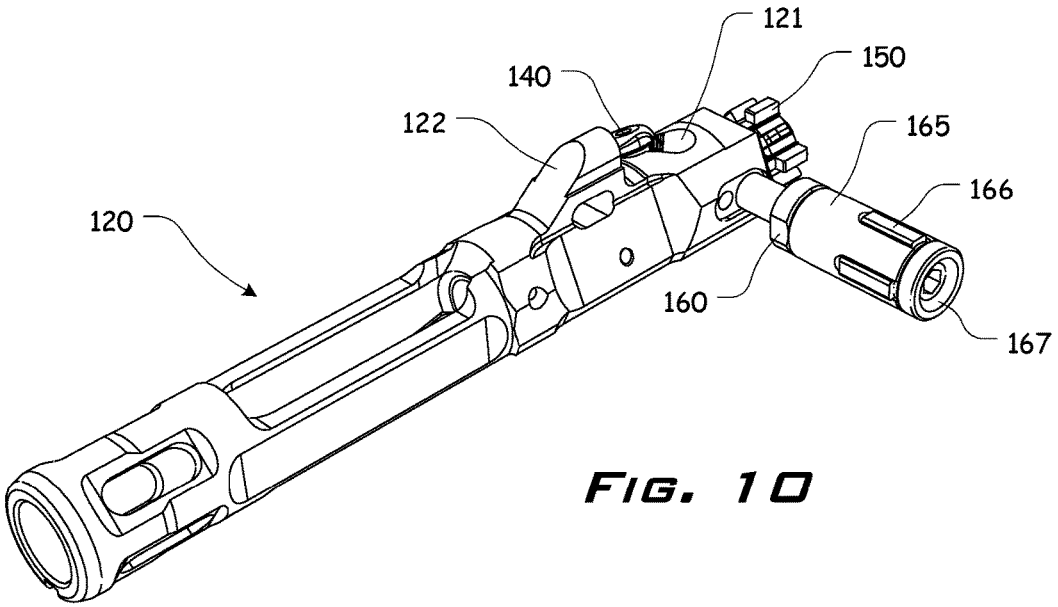
FIG. 10 illustrates an upper, rear, right perspective view of an exemplary embodiment of a bolt carrier and/or removably attachable charging handle, according to the present disclosure.

FIGS. 8-10 illustrate certain elements and/or aspects of an exemplary embodiment of a charging handle bolt carrier 120 and an attached or coupled removably attachable charging handle, according to the present disclosure. As illustrated, the handle sleeve 165 and/or handle insert 166 is attached or coupled to the handle base 160, via the handle retaining bolt 167, to form a handle assembly. The handle assembly may then optionally be aligned with the optional handle adapter 168 and the adapter the base attachment portion 161 is then attached to the attachment aperture 128, securing the optional handle adapter 168 between the charging handle bolt carrier 120 and the handle base 160.

As illustrated most clearly in FIGS. 9-10, the handle assembly may be attached or coupled directly to the charging handle bolt carrier 120 (without use of the optional handle adapter 168), via the handle base 160.

Once the handle assembly is appropriately attached to the charging handle bolt carrier 120, lateral (forward and backward) manipulation of the handle assembly causes lateral (forward and backward) movement of the charging handle bolt carrier 120. This manual manipulation of the charging handle bolt carrier 120 causes the charging and will carrier and bolt 150 to move in a manner similar to the manner in which the bolt carrier group would typically move during the recoil cycle of a standard firearm.

Figure 11A:
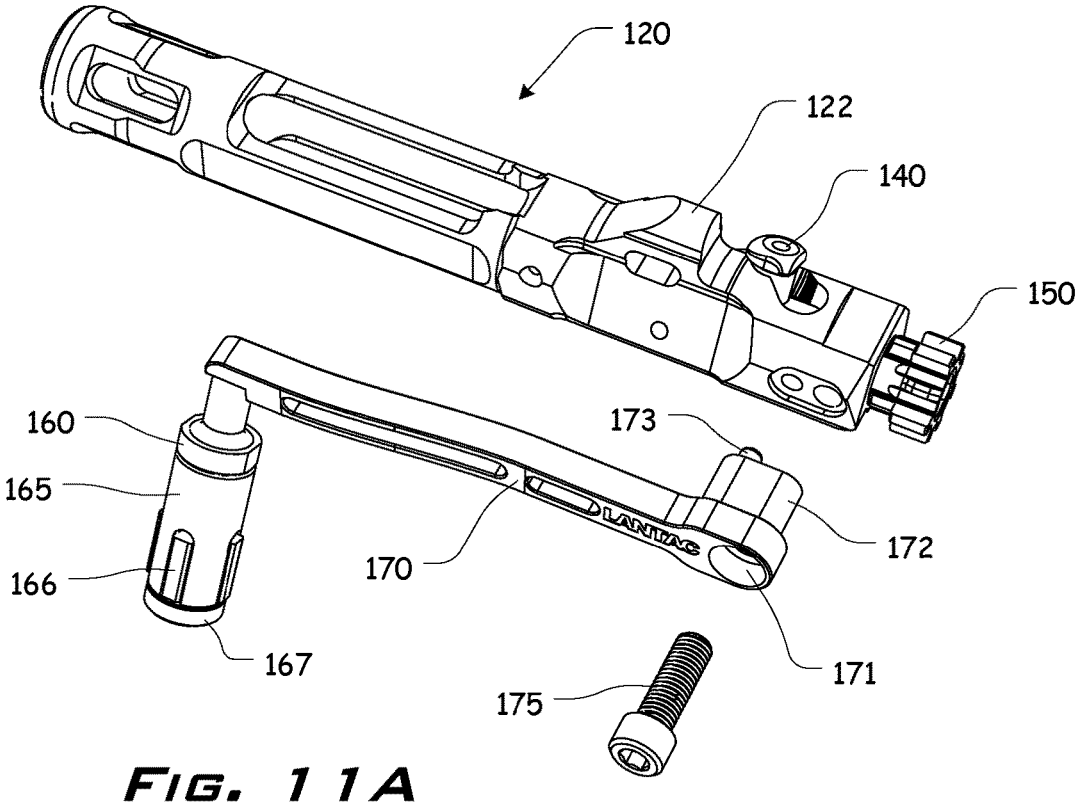
FIG. 11A illustrates a partially exploded, upper, front, right perspective view of an exemplary embodiment of a bolt carrier, adapter arm, and removably attachable charging handle, according to the present disclosure.
Figure 11B:
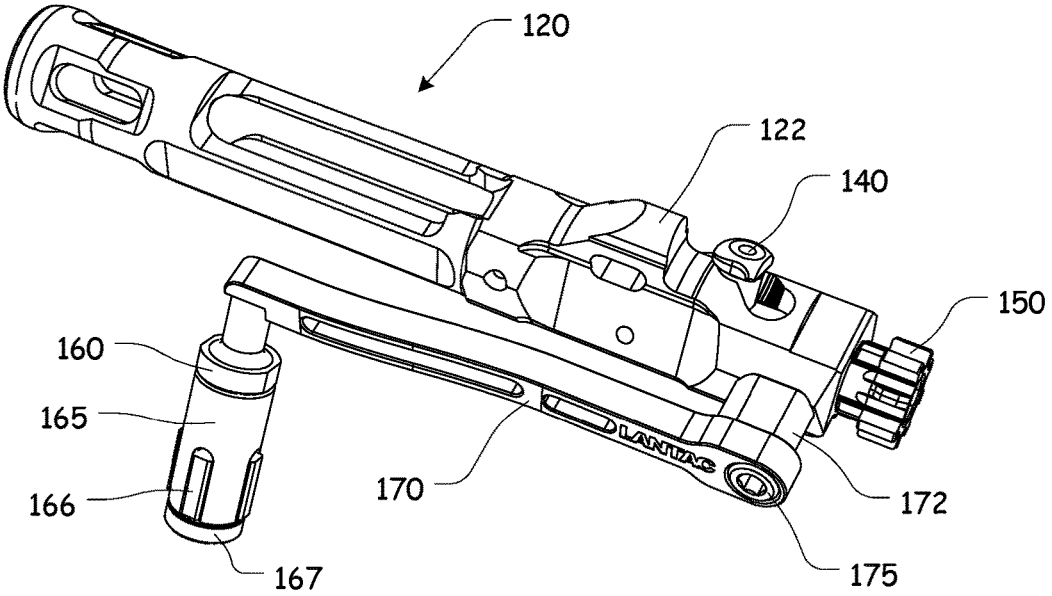
FIG. 11B illustrates an upper, front, right perspective view of an exemplary embodiment of a bolt carrier, adapter arm, and removably attachable charging handle, assembled according to the present disclosure.
Figure 12:
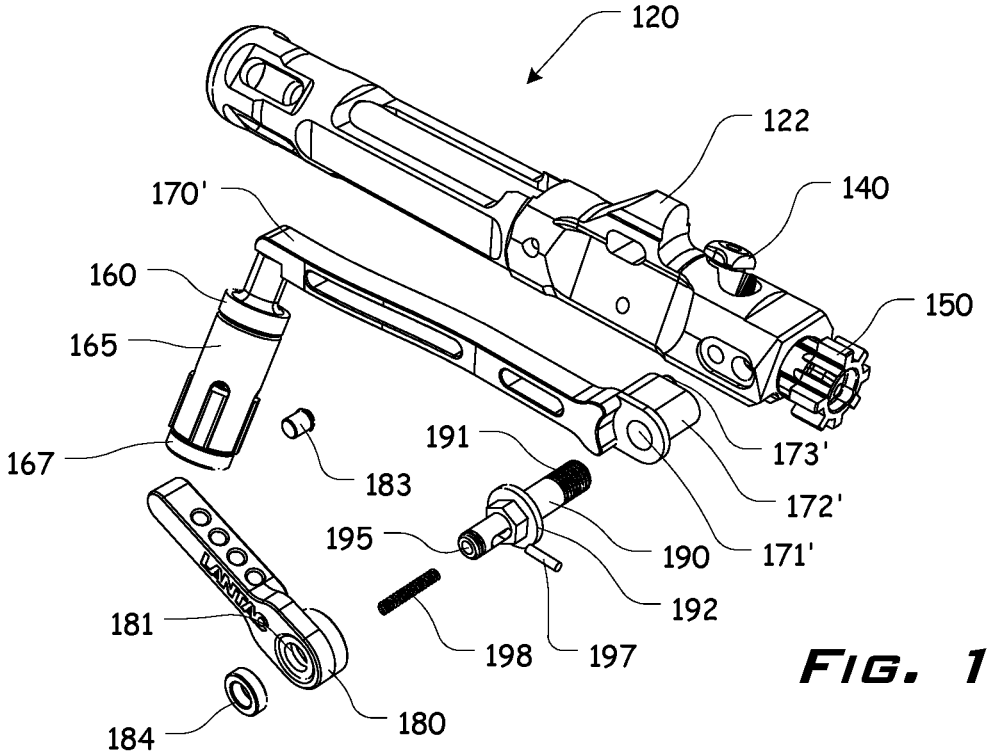
FIG. 12 illustrates a more detailed, partially exploded, upper, front, right perspective view of an exemplary embodiment of a bolt carrier, adapter arm, and removably attachable charging handle, according to the present disclosure.
Figure 13:
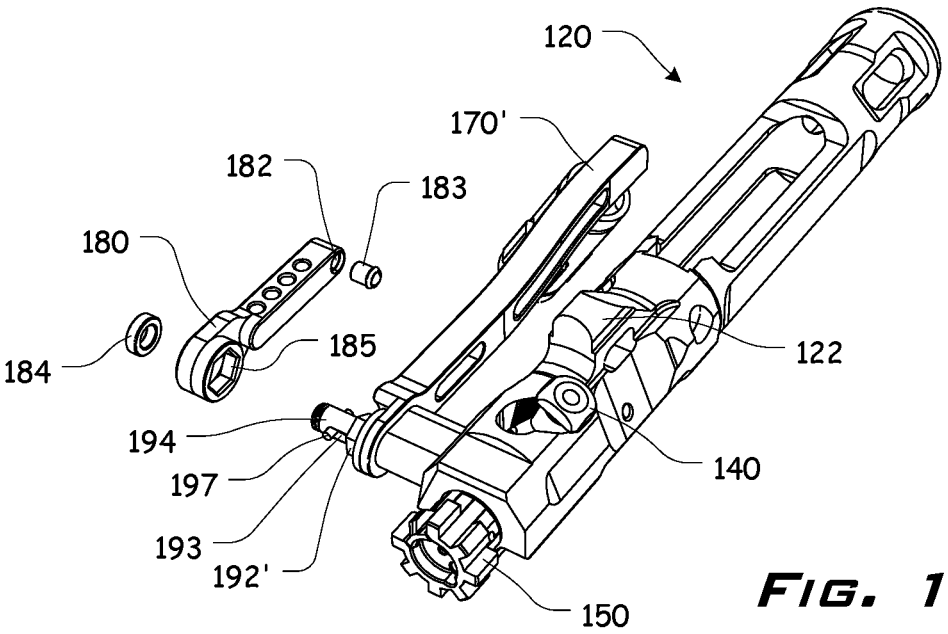
FIG. 13 illustrates a more detailed, partially exploded, upper, front, left perspective view of an exemplary embodiment of a bolt carrier, adapter arm, and removably attachable charging handle, according to the present disclosure.
Figure 14:
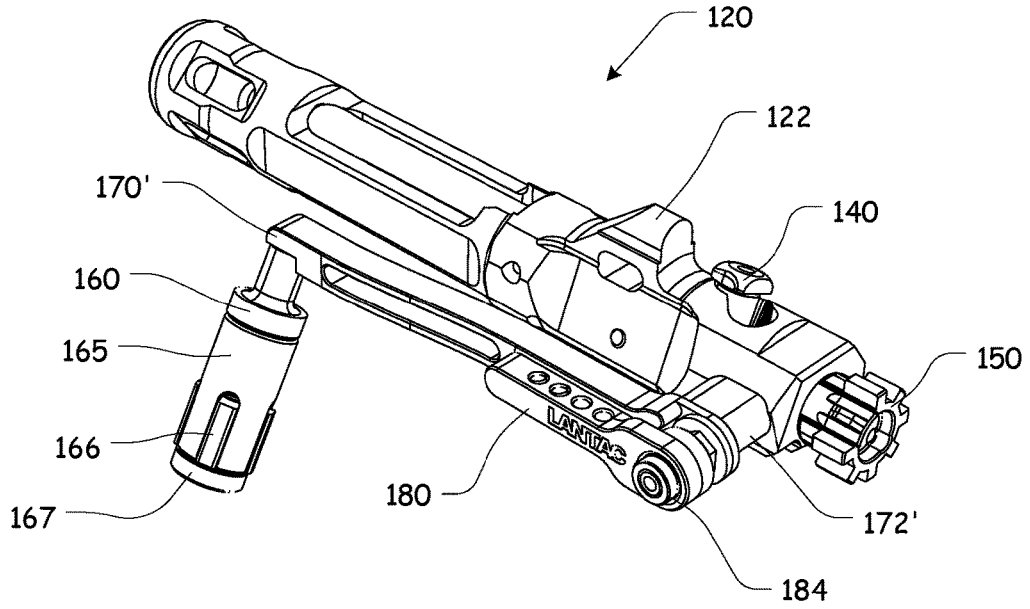
FIG. 14 illustrates an upper, front, right perspective view of an exemplary embodiment of a bolt carrier, adapter arm, and removably attachable charging handle, according to the present disclosure.
Figure 15:
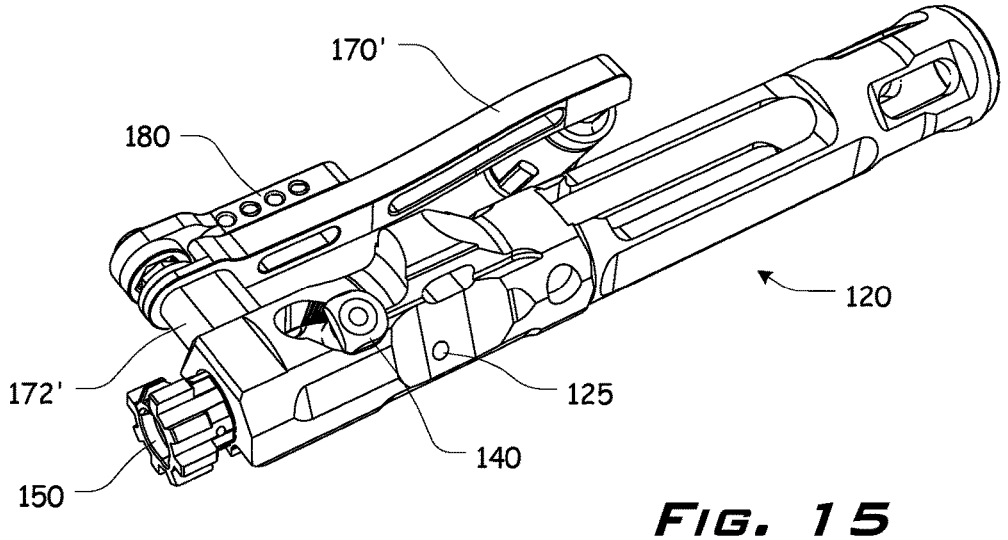
FIG. 15 illustrates an upper, front, left perspective view of an exemplary embodiment of a bolt carrier, adapter arm, and removably attachable charging handle, according to the present disclosure.
Figure 16:
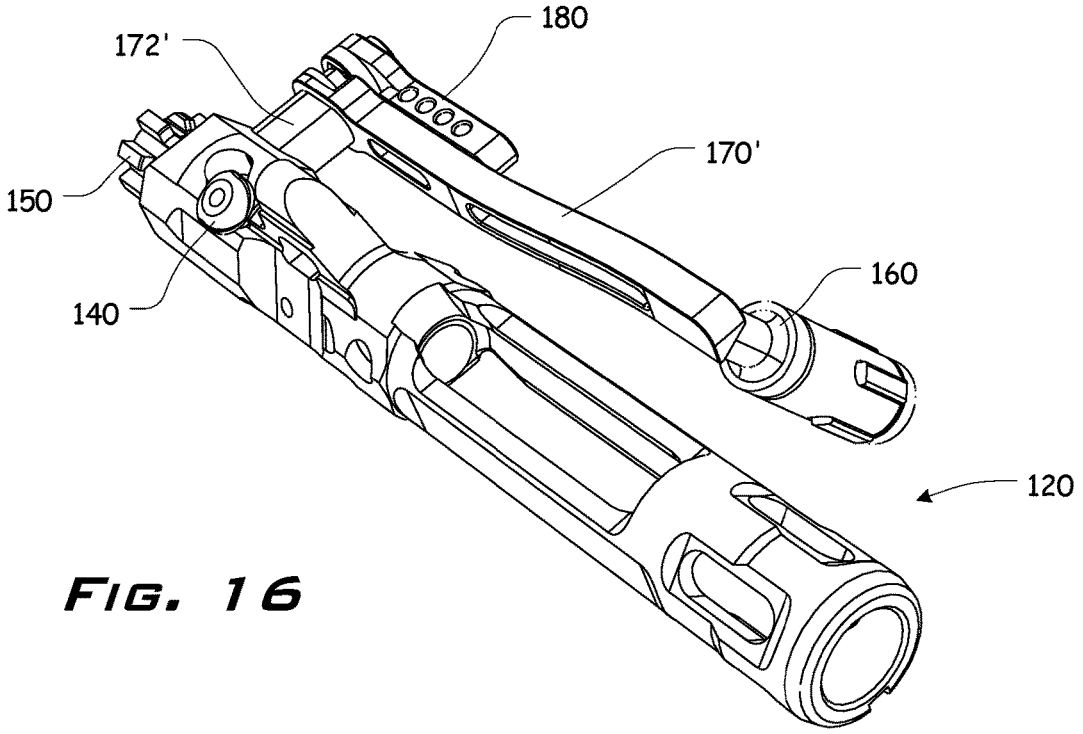
FIG. 16 illustrates an upper, rear, left perspective view of an exemplary embodiment of a bolt carrier, adapter arm, and removably attachable charging handle, according to the present disclosure.
Figure 17:
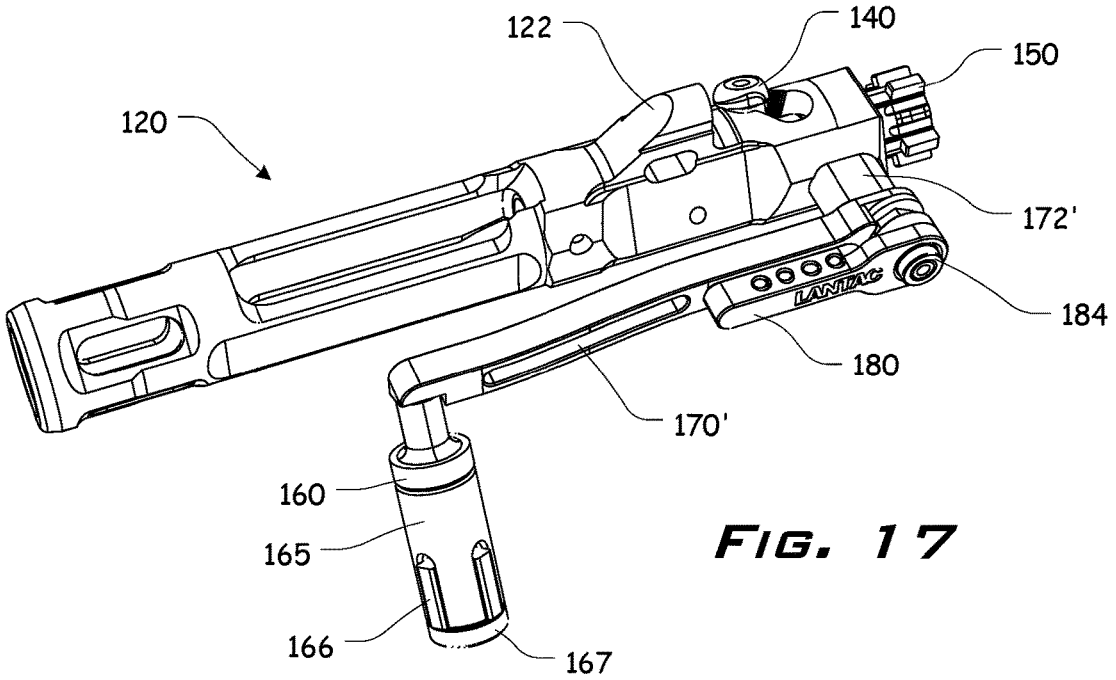
FIG. 17 illustrates an upper, rear, right perspective view of an exemplary embodiment of a bolt carrier, adapter arm, and removably attachable charging handle, according to the present disclosure.

FIGS. 11A-11B illustrate certain elements and/or aspects of an exemplary embodiment of a charging handle bolt carrier 120, an adapter arm 170, and a removably attachable charging handle assembly, according to the present disclosure. As illustrated in FIGS. 11A-11B, the adapter arm 170 comprises adapter arm extension portion 172 that is formed integral to and extends from the adapter arm 170. The adapter arm extension portion 172 includes a registration pin 173 and an adapter arm aperture 171.

The adapter arm 170 comprises an elongate portion of material extending from a first end to a second end. The adapter arm 170 provides an elongate arm, which allows a handle assembly to be attached or coupled proximate a distal end portion of the adapter arm 170. It should be appreciated that the handle assembly may comprise any of the handle assemblies described herein, with reference to at least FIGS. 6-7.

In various exemplary embodiments, the base attachment portion 161 of the handle base 160 is threadedly attached to the adapter arm 170. Alternatively, the base attachment portion 161 may be attached or coupled to the adapter arm 170 via welding, adhesives, friction fit, press fit, or other means. By including the adapter arm 170, the handle assembly can be positioned at a desired location relative to the charging handle bolt carrier 120 and/or the receiver of the firearm.

As illustrated, when the adapter arm extension portion 172 is appropriately aligned with the attachment recess 126 of the charging handle bolt carrier 120, the registration pin 173 is aligned with the alignment aperture 127, and the adapter arm aperture 171 is aligned with the attachment aperture 128, an adapter arm retaining bolt 175 is used to secure the adapter arm 170 to the charging handle bolt carrier 120.

FIGS. 12-17 illustrate certain elements and/or aspects of an exemplary embodiment of a charging handle bolt carrier 120, a removably attachable charging handle assembly, an adapter arm 170', and a locking arm 180, according to the present disclosure. As illustrated in FIGS. 12-17, the adapter arm 170' comprises an adapter arm extension portion 172' that is formed integral to and extends from the adapter arm 170'. The adapter arm extension portion 172' includes a registration pin 173' and an adapter arm aperture 171'.

The adapter arm 170' comprises an elongate portion of material extending from a first end to a second end. The adapter arm 170' provides an elongate arm, which allows a handle assembly to be attached or coupled proximate a distal end portion of the adapter arm 170'. It should be appreciated that the handle assembly may comprise any of the handle assemblies described herein, with reference to at least FIGS. 6-7.

In various exemplary embodiments, the base attachment portion 161 of the handle base 160 is threadedly attached to the adapter arm 170'. Alternatively, the base attachment portion 161 may be attached or coupled to the adapter arm 170' via welding, adhesives, friction fit, press fit, or other means. By including the adapter arm 170', the handle assembly can be positioned at a desired location relative to the charging handle bolt carrier 120 and/or the receiver of the firearm. Thus, the location of the handle assembly is not limited to the ejection port area of the receiver of the firearm. Thus, utilization of the adapter arm 170' allows the handle assembly to be located in an area of the receiver of the firearm other than within the ejection port of the receiver.

A quick disconnect bolt 190 is provided, which comprises a body or portion of material having a central portion 192 with a threaded attachment portion 191 that extends from one side of the central portion 192 and a locking arm attachment portion 194 that extends from the other side of the central portion 192. The threaded attachment portion 191 is adapted to be received through at least a portion of the adapter arm aperture 171' and attached or coupled within at least a portion of the attachment aperture 128.

In various exemplary embodiments, the threaded attachment portion 191 comprises a threaded attachment portion 191, with external threads mateable to the internal threads of the attachment aperture 128. The threaded attachment portion 191 is sized and shaped so as to be received through the adapter arm aperture 171'. As illustrated, when the adapter arm extension portion 172' is appropriately aligned with the attachment recess 126 of the charging handle bolt carrier 120, the registration pin 173' is aligned with the alignment aperture 127, and the adapter arm aperture 171' is aligned with the attachment aperture 128, the threaded attachment portion 191 is able to be threadedly attached to the attachment aperture 128. In this manner, the adapter arm 170' is secured to the charging handle bolt carrier 120, via the quick disconnect bolt 190.

In various exemplary embodiments, the central portion 192 of the quick disconnect bolt 190 includes a bolt nut portion 192', comprising two or more parallel flats, which allow the quick disconnect bolt 190 to be more easily rotated so as to threadedly attach the threaded attachment portion 191 to the attachment aperture 128. In various exemplary, nonlimiting embodiments, the bolt nut portion 192' is capable of being matingly coupled to at least a portion of the locking arm socket 185.

In certain exemplary embodiments, the locking arm attachment portion 194 of the quick disconnect bolt 190 comprises a longitudinal recess 195 extending from a terminal end of the locking arm attachment portion 194, along the longitudinal axis, $A_L$, of the quick disconnect bolt 190. A biasing spring 198 may optionally be positioned within the longitudinal recess 195. A longitudinal slot 193 is formed through the locking arm attachment portion 194, along at least a portion of the longitudinal recess 195. A pressure pin 197 is positioned through the longitudinal slot 193.

The biasing spring 198 is compressed within the longitudinal recess 195 and the pressure pin 197 is positioned within the longitudinal slot 193 such that the biasing spring 198 is captured within the longitudinal recess 195 between a bottom wall of the longitudinal recess 195 and the pressure pin 197. The spring bias of the biasing spring 198 maintains the pressure pin 197 against a distal end of the longitudinal slot 193. In this manner, a portion of the pressure pin 197 extends through opposing sides of the longitudinal slot 193 and beyond the diameter of the locking arm attachment portion 194.

A portion of the distal end of the locking arm attachment portion 194 is threaded so as to be threadedly attached, via the distal threads, to a retaining nut 184.

The locking arm 180 extends from a first end to a second end and includes a locking arm aperture 181 formed through the locking arm 180, substantially perpendicular to the longitudinal axis of the locking arm 180. A socket extends at least partially into the locking arm aperture 181 and is formed so as to accept and capture at least a portion of the pressure pin 197. By capturing at least a portion of the pressure pin 197, when the locking arm 180 is attached to the locking arm attachment portion 194, rotation of the locking arm 180 causes corresponding rotation of the quick disconnect bolt 190.

Thus, as the locking arm 180 is attached to the locking arm attachment portion 194 of the quick disconnect bolt 190, the exposed portions of the pressure pin 197 are fitted within appropriate portions of the socket and, as the locking arm 180 continues to be urged onto the locking arm attachment portion 194, the spring bias of the biasing spring 198 is overcome and the pressure pin 197 is able to move within the longitudinal slot 193, if necessary. As the locking arm 180 is appropriately positioned onto the locking arm attachment portion 194, the retaining nut 184 can be threaded to the attached to the distal threads of the locking arm attachment portion 194, securing the locking arm 180 to the quick disconnect bolt 190.

In certain exemplary, nonlimiting embodiments, the locking arm 180 further comprises a detent recess 182 formed in a portion of the locking arm 180. If included, the detent recess 182 is formed and positioned so as to accept at least a portion of a locking detent 183 in a position that allows the locking detent 183 to interact with a hole in the adapter arm 170'. In various exemplary embodiments, the locking detent 183 comprises a resilient material, such as, for example, rubber or silicone. In these exemplary embodiments, when the locking arm 180 is appropriately attached or coupled to the locking arm attachment portion 194 of the quick disconnect bolt 190, the locking arm 180 can be rotated to threadedly secure the quick disconnect bolt 190 to the attachment aperture 128 of the charging handle bolt carrier 120. The locking arm 180 can be rotated sufficiently such that the locking detent 183 is aligned with the registration hole, slot, recess, or groove in the adapter arm 170' and the resilience of the locking detent 183 maintains the locking detent 183 in the hole of the adapter arm 170' and the locking arm 180 in an appropriate position relative to the locking arm 180.

In certain other exemplary, nonlimiting embodiments, the pressure detent 197 may be formed of a more rigid material and may be spring biased to extend at least partially from the detent recess 182. In these exemplary embodiments, the spring bias can be overcome to allow the pressure detent 197 to be at least partially seated or registered within the registration hole, slot, recess, or groove in the adapter arm 170' when the locking arm 180 is in an appropriate position.

Thus, as illustrated in FIGS. 12-17, a removable or quick disconnect lever or locking arm 180 is provided. In these exemplary embodiments, the lever or locking arm 180 is configured to be pushed down against an integrated biasing spring 198 to engage with the bolt nut portion 192'. In this manner, the lever or locking arm 180 can be used to tighten and untighten the quick disconnect bolt 190 that holds the adapter arm 170' onto the charging handle bolt carrier 120. So a tool is not required to mount or un-mount the adapter arm 170' and handle assembly. This configuration also allows the adapter arm 170'/handle assembly to be tightened should the adapter arm 170'/handle assembly come loose from the charging handle bolt carrier 120.

It is believed that the level of description provided herein is sufficient to enable one of ordinary skill in the art to understand and practice the present invention, as described.

While this disclosure has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present invention. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A bolt carrier and removably attachable charging handle, comprising:

a bolt carrier having at least one attachment aperture and at least one alignment aperture;

an adapter arm extending from a first end to a second end, an adapter arm extension portion extending proximate said first end of said adapter arm, wherein said adapter arm extension portion includes at least one adapter arm aperture formed therethrough, wherein said adapter arm aperture is capable of being aligned with said attachment aperture, wherein said adapter arm extension portion further comprises at least one registration pin extending from said adapter arm extension portion, wherein said registration pin is capable of being at least partially received within said alignment aperture;

a quick disconnect bolt, wherein said quick disconnect bolt comprises a central portion with a threaded attachment portion that extends from a first side of said central portion and a locking arm attachment portion that extends from a second side of said central portion, wherein at least a portion of said attachment portion is capable of passing through said adapter arm aperture and interacting with said attachment aperture;

a handle base having a base attachment portion and a handle attachment portion, wherein said base attachment portion is capable of being attached or secured proximate said second end of said adapter arm; and a handle sleeve capable of being removably attached or coupled to said handle attachment portion of said handle base.

2. The bolt carrier and removably attachable charging handle of claim 1, further comprising an attachment recess portion formed in at least a portion of said bolt carrier, wherein said attachment recess portion is formed around said at least one attachment aperture, and wherein said attachment recess portion is formed to receive at least a portion of said adapter arm extension portion at least partially therein.

3. The bolt carrier and removably attachable charging handle of claim 1, further comprising an attachment recess portion formed in at least a portion of said bolt carrier, wherein said attachment recess portion is formed around said at least one attachment aperture and said at least one alignment aperture, and wherein said attachment recess portion is formed to receive at least a portion of said adapter arm extension portion at least partially therein.

4. The bolt carrier and removably attachable charging handle of claim 1, wherein said handle sleeve is attached or coupled to said handle attachment portion via a handle retaining bolt.

5. The bolt carrier and removably attachable charging handle of claim 1, further comprising a handle insert that interacts with said handle sleeve.

6. The bolt carrier and removably attachable charging handle of claim 1, wherein said locking arm attachment portion of said quick disconnect bolt further comprises:

a longitudinal recess extending from a terminal end of said locking arm attachment portion;

a biasing spring positioned within said longitudinal recess;

a longitudinal slot formed through said locking arm attachment portion, along at least a portion of said longitudinal recess;

a pressure pin positioned through said longitudinal slot, wherein said spring is compressed within said longitudinal recess and said pressure pin is positioned within said longitudinal slot such that said spring is captured within said longitudinal recess between a bottom wall of said longitudinal recess and said pressure pin, wherein said spring bias of said spring maintains said pressure pin against a distal end of said longitudinal slot;

wherein a portion of said distal end of said locking arm attachment portion is threaded so as to be threadedly attached, via said distal threads, to a retaining nut;

a locking arm that extends from a first end to a second end and includes a locking arm aperture formed through said locking arm; and a socket extending at least partially into said locking arm aperture and formed so as to accept and capture at least a portion of said pressure pin.

* * * * *